US006309247B1

(12) United States Patent
Wang

(10) Patent No.: US 6,309,247 B1
(45) Date of Patent: Oct. 30, 2001

(54) ELECTRICAL CONNECTOR HAVING A DUST-PROOF COVER

(75) Inventor: Sui Ya Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 89 days.

(21) Appl. No.: 09/746,247

(22) Filed: Dec. 21, 2000

(30) Foreign Application Priority Data

Aug. 8, 2000 (TW) ..... 089213773 U

(51) Int. Cl.[7] ..... H01R 13/52

(52) U.S. Cl. ..... 439/521; 439/148; 439/135; 439/354; 439/892

(58) Field of Search ..... 439/135, 136, 439/137, 138, 139, 140, 148, 149, 354, 519, 521, 367, 892

(56) References Cited

U.S. PATENT DOCUMENTS 5,161,988 * 11/1992 Krupka ..... 439/136
5,224,868 * 7/1993 Tseng ..... 439/136
5,299,943 * 4/1994 Shieh ..... 439/136
5,637,002 * 6/1997 Buck et al. ..... 439/148

FOREIGN PATENT DOCUMENTS 5-217624 * 8/1993 (JP) ..... 439/521

* cited by examiner

*Primary Examiner*—Tho D. Ta
(74) *Attorney, Agent, or Firm*—Wei Te Chung

(57) ABSTRACT

A receptacle connector (1) comprises an insulative housing (10) defining a receiving space (11) for receiving a mating plug connector, a plurality of contacts (20) received in the housing, and a dust-proof cover (40). The receiving space further has an opening (12) adjacent to a front surface (50) of the housing for extension of the mating plug connector therethrough into the receiving space. The cover includes a board (41) for being lodged in the opening when the mating plug connector is not inserted in the connector for preventing dust from entering into the receiving space. The cover also includes a pair of fixed arms (43) extending from a rear side of the board and a spring portion (42) connected between the arms and first extending upwardly then forwardly toward the board. The spring portion further defines a recess (42*c*) in a free end thereof for receiving a tip of a tool to receive first a depressing force and then a forward force from the tool to remove the cover from the receptacle connector.

12 Claims, 7 Drawing Sheets

ELECTRICAL CONNECTOR HAVING A DUST-PROOF COVER

BACKGROUND OF THE INVENTION

1. Field of the Invention

The present invention relates to an electrical connector, and particularly to a receptacle connector used in communication which has a cover for preventing dust from entering into the connector and contaminating the contacts thereof.

2. Description of the Prior Art

Generally, a computer is equipped with at least one connector, for example an RJ45 receptacle connector, for communicating with a server through a network, for example, a Local Area Network (LAN). The receptacle connector has a plurality of contacts for engaging with an inserted mating connector, and a receiving space for receiving the mating connector. The connector can be in two different states, namely, engaged with or disengaged from the mating connector. When disengaged from the mating connector, the receiving space of the connector is exposed to the outside. In this condition, contaminants, especially dust, may enter into the receiving space. When contaminants adhere to the surface of the contacts, they can degrade the electrical connection between the receptacle connector and the mating connector, and can further influence the quality of signal transmissions therebetween.

Hence, an improved electrical connector is required to overcome the disadvantages of the prior art.

BRIEF SUMMARY OF THE INVENTION

A main object of the present invention is to provide a receptacle connector having a dust-proof cover for preventing dust or other contaminants from entering into the receptacle connector, thereby ensuring high quality signal transmissions between the receptacle connector and a mating connector.

To achieve the above-mentioned object, a receptacle connector in accordance with the present invention comprises an insulative housing defining a receiving space for receiving a mating plug connector, a plurality of contacts received in the insulative housing, and a dust-proof cover. The receiving space further has an opening adjacent to a front surface of the housing for extension of the plug connector therethrough into the receiving space. Each contact includes a mating portion extending into the receiving space, a securing portion embedded in a bottom plate of the housing, and a tail portion extending from the securing portion beyond the bottom plate of the insulative housing. The cover includes a board for being located in the opening when the mating plug connector is not plugged therein, for preventing dust from entering into the receiving space. The cover also includes a pair of fixed arms extending from a rear side of the board and a spring portion connected between the arms and first extending upwardly then forwardly toward the board. The spring portion further has a recess in a free end thereof for accommodating a manipulating tool. To disassemble the dust-proof cover from the connector, a tip of the manipulating tool is inserted into the recess and exerts a depressing force thereto, whereby the cover is easily separated from the connector.

Other objects, advantages and novel features of the invention will become more apparent from the following detailed description of the present embodiment when taken in conjunction with the accompanying drawings.

DETAILED DESCRIPTION OF THE INVENTION

Figure 1:
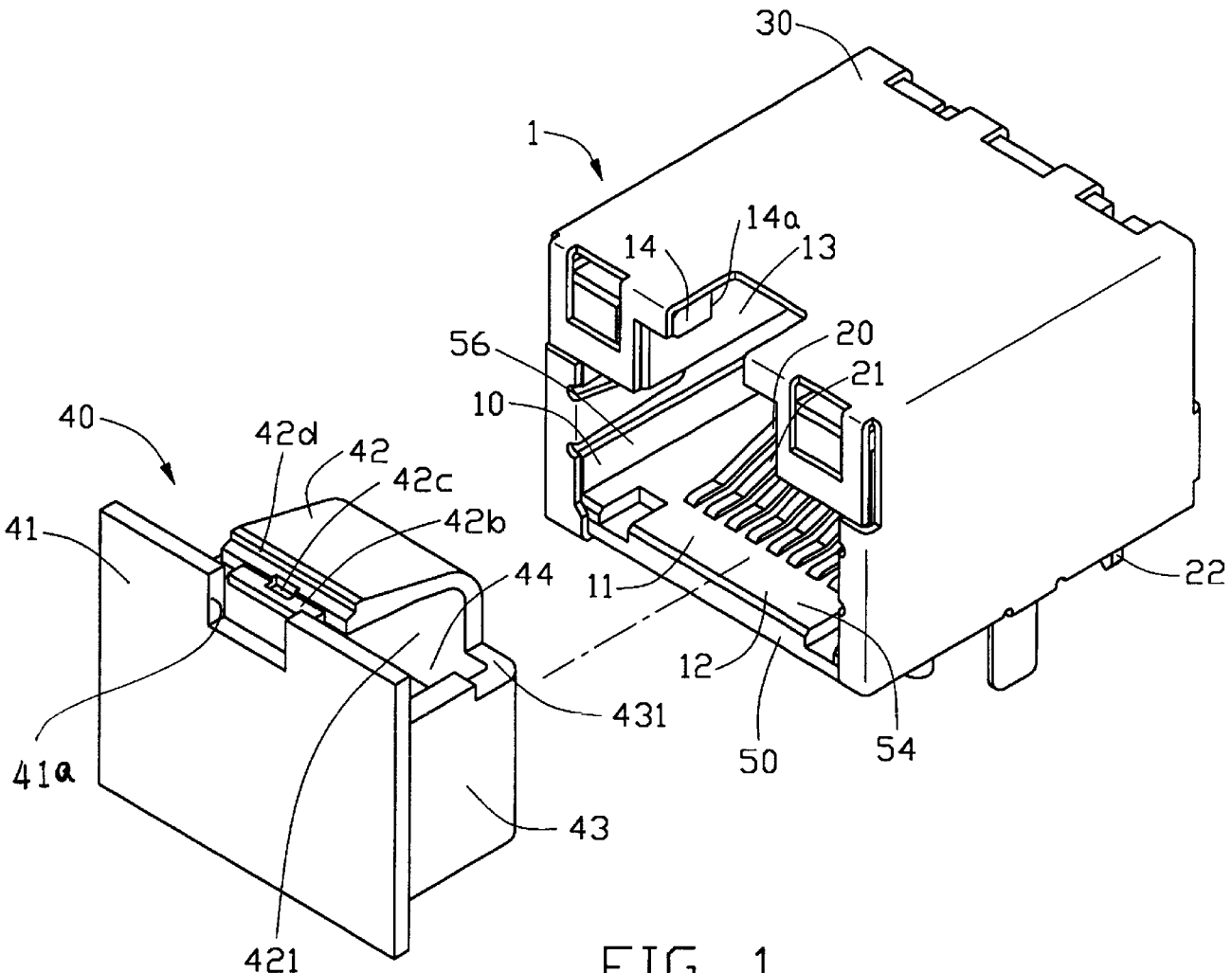
FIG. 1 is a perspective, exploded view of a receptacle connector having a dust-proof cover in accordance with a first embodiment of the present invention.
Figure 2:
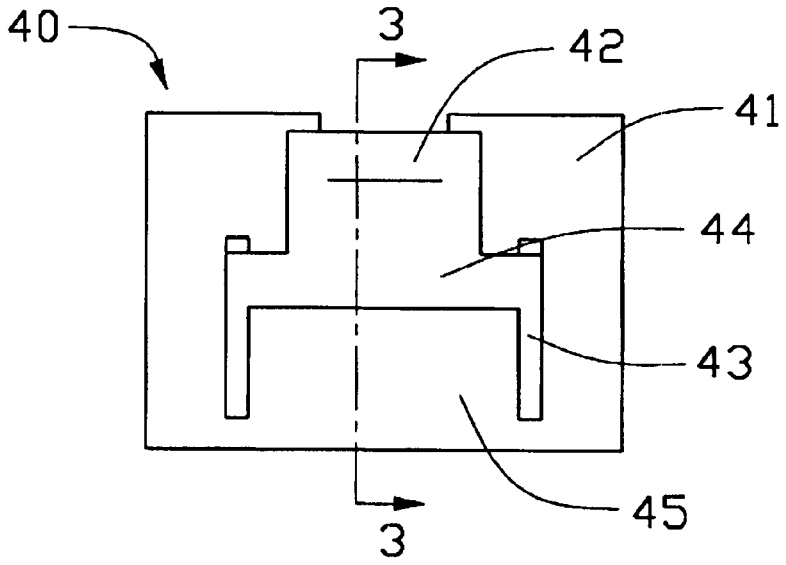
FIG. 2 is a rear plan view of the cover of FIG. 1.
Figure 3:
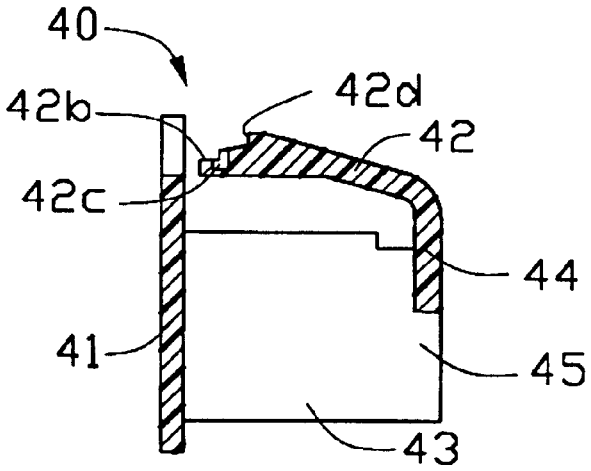
FIG. 3 is a cross-sectional view of the cover taken along line 3—3 of FIG. 2.

Referring to FIGS. 1, 2 and 3, a receptacle connector 1 has a dust-proof cover 40 in accordance with a first embodiment of the present invention. The receptacle connector 1 is an RJ-45 receptacle modular jack. The connector 1 comprises an insulative housing 10 defining a receiving space 11 therein for receiving a mating plug connector (not shown), a plurality of contacts 20 received in the insulative housing 10, and a shield shell 30 enclosing the insulative housing 10.

The insulative housing 10 forms a top plate 52 (see FIG. 5), a bottom plate 54, and two sidewalls 56. The receiving space 11 is located between the top plate 52, the bottom plate 54, and two sidewalls 56. The receiving space 11 further has an opening 12 adjacent to a front surface 50 of the insulative housing 10 for inserting the mating plug connector therein. A cutout 13 is defined in the top plate 52, extending rearwardly from a middle portion of a front edge thereof. A pair of blocks 14 are formed by the top plate 52 and are symmetrically positioned on opposite sides of the cutout 13. Each block 14 has a rear face functioning as a stop face 14*a*.

Each contact 20 consists of a mating portion 21 extending into the receiving space 11 of the insulative housing 10, a securing portion (not shown) embedded in the bottom plate 54 of the housing 10, and a tail portion 22 extending from the securing portion beyond the bottom plate 54 of the insulative housing 10.

The cover 40 includes a board 41 for being located in the opening 12 with optionally a cutout 41*a* in register with the cutout 13 of the housing 10, a pair of fixed arms 43 symmetrically extending rearwardly from a rear side of the board 41, an intermediate section 44 connecting with free edges 431 of the fixed arms 43, where the free edges point toward each other, and a spring portion 42 first extending upwardly from the intermediate section 44 and then forwardly toward the board 41. A hollow 421 is defined between the board 41, the intermediate section 44, and the fixed arms 43. The intermediate section 44 and the fixed arms 43 form an opening 45 therebetween. In addition, a step portion 42*d* is formed by the springportion 42 adjacent to a free end thereof. A tab 42*b* extends forward from the free end of the spring portion 42. A recess 42*c* is defined between the tab 42*b* and the free end of the spring portion 42 and is located below the step portion 42*d* of the spring portion 42.

Figure 4:
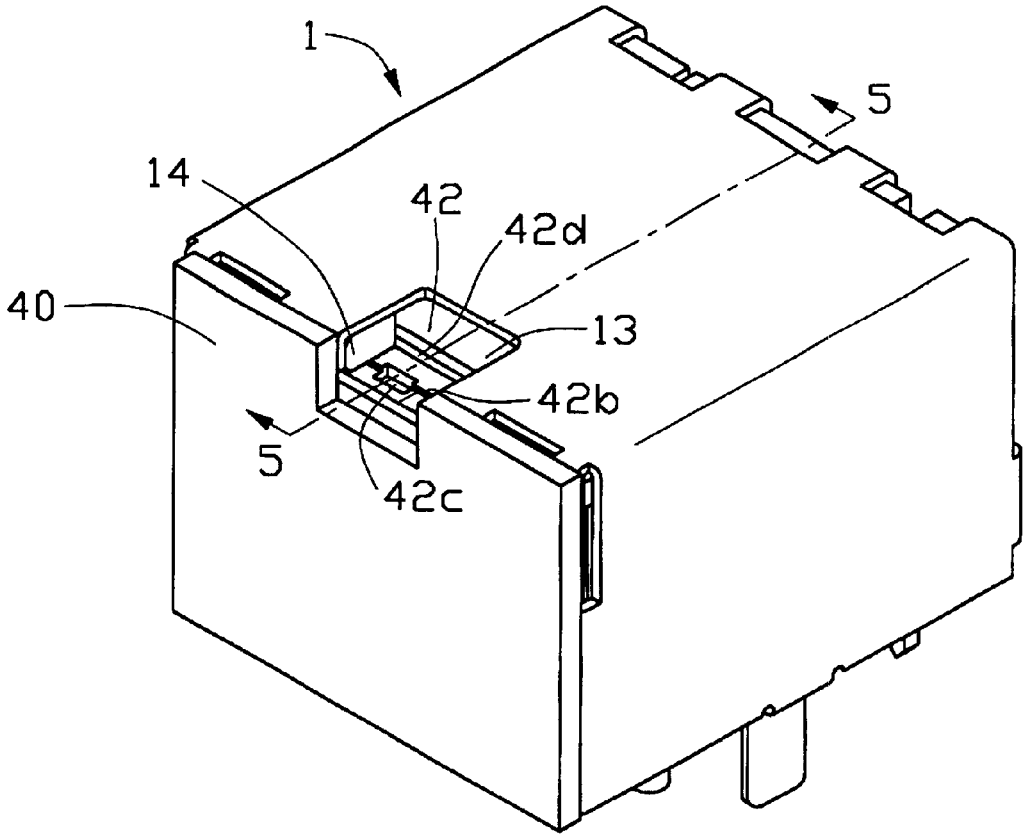
FIG. 4 is a perspective view of the receptacle connector assembled with the cover shown in FIG. 1.
Figure 5:
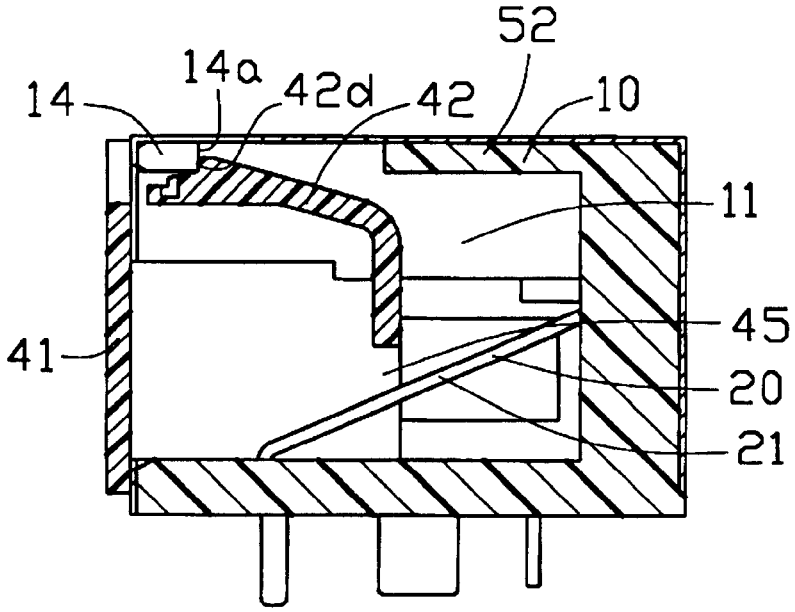
FIG. 5 is a cross-sectional view of the receptacle connector taken along line 5—5 of FIG. 4.

In assembly, referring to FIGS. 4 and 5, the cover 40 is inserted into the receiving space 11 of the insulative housing 10 to a position wherein the board 41 of the cover 40 is placed in the opening 12, and other parts of the cover 40 are received in the receiving space 11. The mating portion 21 of each contact 20 extends into the opening 45 of the cover 40. During the assembly, the free end of the spring portion 42 firstpasses beneath bottom faces of the blocks 14 of the insulative housing 10 under a depressed condition, and then springs upwardly so that the step portions 42*d* abut against the rear, lower corners of the blocks 14. Thus, the cover 40 is firmly fixed in the receiving space 11, and the board 41 covers the opening 12 to effectively prevent contaminants from entering into the receiving space 11. At the same time, the recess 42*c* in the tab 42*b* is exposed to an outside of the connector through the cutout 13 of the insulative housing 10.

Figure 6:
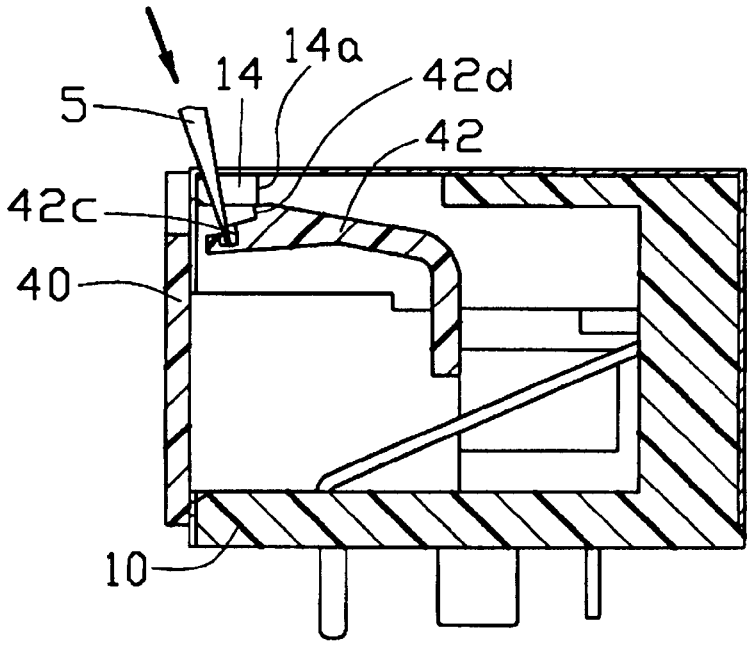
FIG. 6 is a view similar to FIG. 5 with a tool being used to remove the cover from the connector at a first stage.
Figure 7:
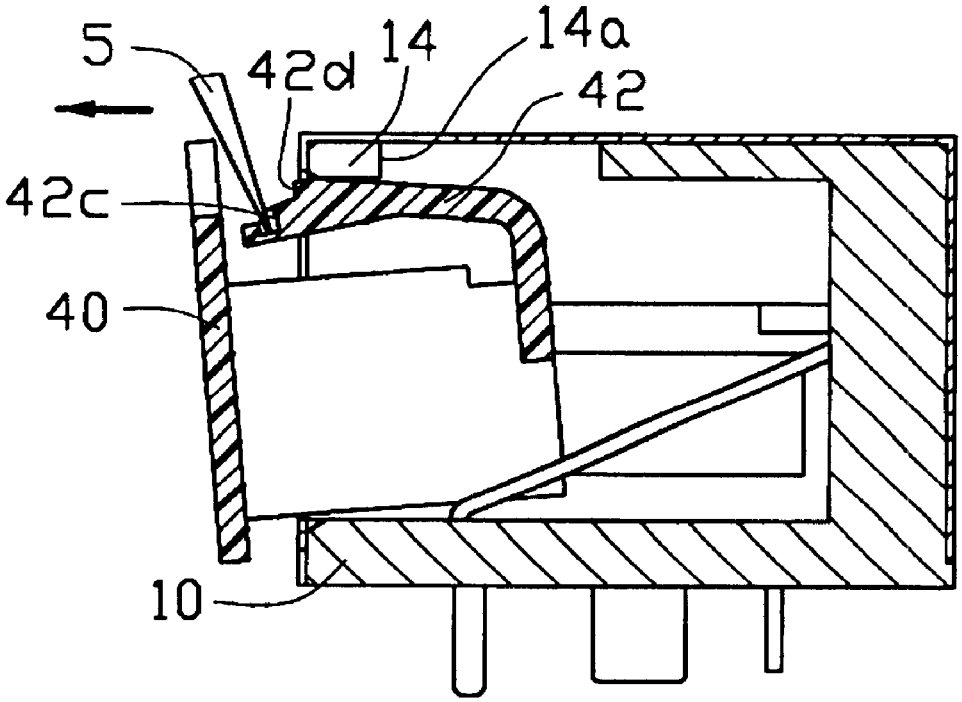
FIG. 7 is a view similar to FIG. 6 with the tool removing the cover at a second stage.

Referring to FIGS. 6 and 7, to disassemble the dust-proof cover 40 from the connector 1, the tip of a manipulating tool, such as a flat screwdriver 5, is inserted into the recess 42*c* and is pressed downward there against, thereby releasing an engagement between the step portion 42*d* and the blocks 14. Thereafter, a forward force is exerted by the screwdriver 5 to actuate the free end of the spring portion 42 to passbeneath the bottom faces of the blocks 14 until the dust-proof cover 40 is separated from the connector 1.

Figure 8:
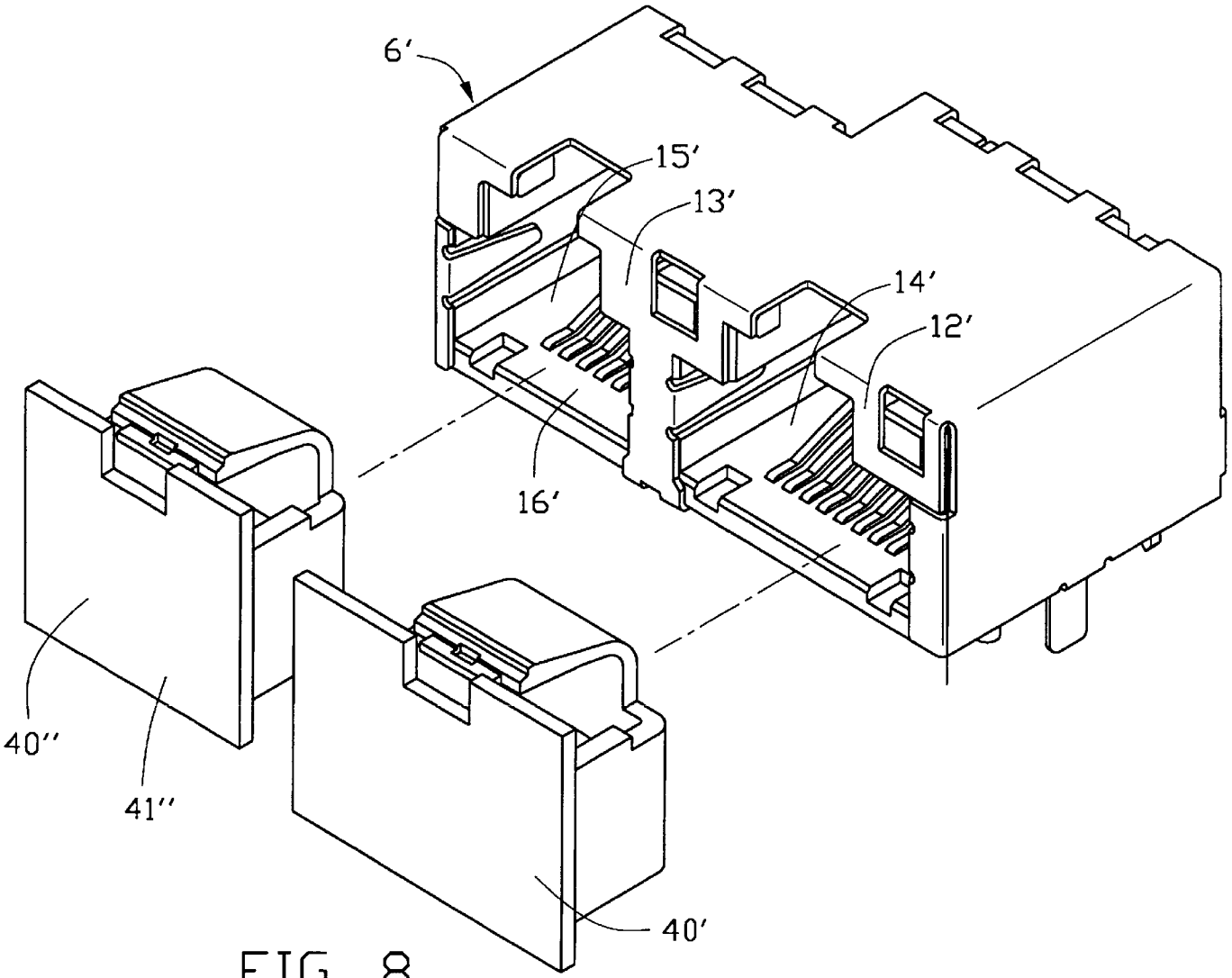
FIG. 8 is a perspective, exploded view of a receptacle connector assembly having two receptacle connectors arranged side-by-side, each connector being provided with a dust-proof cover in accordance with the first embodiment of the present invention.

Referring to FIG. 8, two covers 40', 40" are shown which are assembled in a receptacle connector assembly 6' which consists of an RJ45 receptacle modular jack 12' and an RJ11 receptacle modular jack 13'. The covers 40', 40" are respectively received in a receiving space 14' of the RJ45 receptacle modular jack 12' and a receiving space 15' of the RJ11 receptacle modular jack 13'. The cover 40' has a configuration and size identical to that of the cover 40. The cover 40" has a configuration substantially the same as that of the cover 40', except for a smaller board 41", because the RJ11 receptacle modular jack 13' has an opening 16' smaller than that of the RJ45 receptacle modular jack 12'.

Figure 9:
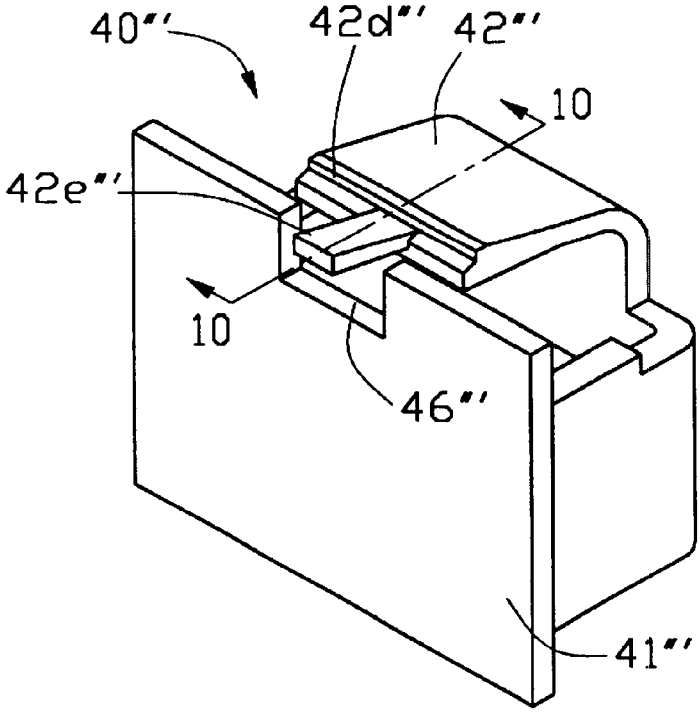
FIG. 9 is a perspective view of a dust-proof cover in accordance with a second embodiment of the present invention.
Figure 10:
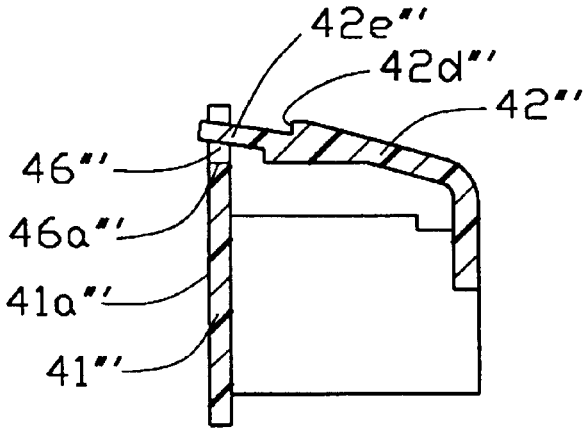
FIG. 10 is a cross-sectional view of the cover of FIG. 9 taken along line 10—10 of FIG. 9.

Referring to FIGS. 9 and 10, a dust-proof cover 40'" is shown in accordance with a second embodiment of the present invention. In this embodiment, the cover 40'", like the cover 40, is used in the RJ45 receptacle modular jack 1 for preventing contaminants from entering into the receiving space 11. An arm 42*e'"* extends forward from a free end of a spring portion 42'" of the cover 40'" through a cutout 46'" defined in a middle, upper portion of a board 41'" and beyond a front surface 41*a'"* of the board 41'". A bottom edge 46*a'"* of the cutout 46'" prevents the arm 42*e'"* from being depressed too excessively, thereby ensuring that the arm 42*e'"*and the spring portion 42'" will not be damaged during disassembly of the cover 40'" from the modular jack. When the cover 40'" is assembled to the receptacle connector 1, a step portion 42*d'"* of the spring portion 42'" of the cover 40'" abuts against the blocks 14 of the receptacle connector 1 (FIG. 1). To disassemble the dust-proof cover 40'" from the receptacle connector 1, the arm 42*e'"* is pressed down by a user's finger, thereby depressing a free end of the arm 42*e'"* beyond the board 41'", thereby releasing the engagement between the step portion 42*d'"* and the blocks 14 of the receptacle connector 1. Thereafter, a forward force is exerted on the arm 42*e'"* to actuate the free end of the spring portion 42'" to pass beneath the bottom faces of the blocks 14 until the dust-proof cover 40'" is separated from the receptacle connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A receptacle connector adapted to receive a mating plug connector, comprising:

an insulative housing having a receiving space for receiving the mating plug connector, and an opening adjacent to a front surface of the housing for extension of the plug connector therethrough into the receiving space;

a plurality of contacts received in the housing, each contact having at least a mating portion extending into the receiving space;

a dust-proof cover having a board for being located in the opening when the mating plug connector is not plugged into the receptacle connector for preventing dust from entering into the receiving space, the dust-proof cover further having a resilient spring portion first extending upwardly from a support portion mounted to a rear side of the board and then forwardly toward the rear side of the board, said spring portion having a first section which resiliently engages with the housing thereby securing the cover to the housing, and an exposed section by which an exterior force can be exerted against the spring portion to release the engagement of the first section thereof with the housing;

wherein the housing forms a top plate and a cutout is defined in the top plate and the top plate further forms a block positioned beside the cutout, and the first section of the spring portion is a step portion formed in the shape of a step, said step portion engaging in assembly with the block, the exposed section of the spring portion being a recess defined in the spring portion and located to be exposed in the cutout when the cover is assembled in the receptacle connector;

wherein the recess receiving a tip of a tool to receive first a depressing force and then a forward force from the tool for operatively disengaging the engagement of said first section of the spring portion from the housing; and wherein the spring portion has an opening at a lower side thereof through which the mating portions of the contacts extend.

2. The receptacle connector as claimed in claim 1, wherein each contact has a tail portion extending beyond a bottom plate of the insulative housing.

3. The receptacle connector as claimed in claim 1, wherein the receptacle connector is a modular jack receptacle connector.

4. A receptacle connector adapted to receive a mating plug connector, comprising:

an insulative housing having a receiving space for receiving the mating plug connector, and an opening adjacent to a front surface of the housing for extension of the plug connector therethrough into the receiving space;

a plurality of contacts received in the housing, each contact having at least a mating portion extending into the receiving space;

a dust-proof cover having a board for being located in the opening when the mating plug connector is not plugged into the receptacle connector for preventing dust from entering into the receiving space, the dust-proof cover further having a resilient spring portion first extending upwardly from a rear side of the board and then forwardly toward the rear side of the board for being received in the receiving space, the spring portion having a first section which resiliently engages with the housing thereby securing the cover to the housing, and an exposed section by which an exterior force can be exerted against the spring portion to release the engagement of the first section thereof with the housing;

wherein a cutout is defined in a top plate of the housing, and a block is formed by the top plate and positioned beside the cutout, and the first section of the spring portion is a step portion formed on the spring portion, and said step portion engages with the block, and the exposed section of the spring portion is an arm extending from a front free end of the spring portion and beyond a front surface of the board;

wherein the arm is used for being manipulated by a finger of a user to receive a first depressing force and then a forward force from the finger for operatively disengaging the engagement section of said first section from the housing; and wherein the spring portion has an opening at a lower side thereof through which the mating portions of the contacts extend.

5. The receptacle connector as claimed in claim 4, wherein each contact has a tail portion extending beyond a bottom plate of the insulative housing.

6. The receptacle connector as claimed in claim 4, wherein each contact has a tail portion extending beyond a bottom plate of the insulative housing.

7. The receptacle connector as claimed in claim 4, wherein a cutout is defined in an upper portion of the board for the arm to extend therethrough.

8. The receptacle connector as claimed in claim 7, wherein the receptacle connector is a modular jack receptacle connector.

9. A receptacle connector assembly comprising:

an insulative housing having a receiving space for receiving the mating plug connector, and an opening adjacent to a front surface of the housing for extension of the plug connector there through into the receiving space;

a plurality of contacts received in the housing, each contact having at least a mating portion extending into the receiving space; and a dust-proof cover having a board covering the opening when no mating plug connector is plugged into the receptacle connector for preventing dust from entering into the receiving space, the dust-proof cover further having a spring portion extending from the board into the receiving space, said spring portion including an engagement section latchably engaged with the housing; wherein at least a cutout is formed in the board so as to expose the spring portion to an exterior along a horizontal direction of the connector; wherein an arm extends forward from a free end of the spring portion through said cutout and beyond a front surface of the board for operatively disengaging the engagement section of the spring portion from the housing.

10. The assembly as claimed in claim 9, wherein both the housing and the board define corresponding cutouts respectively, and the cutout of the housing and the cutout of the board are aligned with each other in a front-to-back direction and close to said engagement section of the spring portion.

11. The assembly as claimed in claim 9, wherein said a pair of blocks are formed on the housing by two sides of said cutout when said cutout is formed in the housing.

12. The assembly as claimed in claim 11, wherein the engagement section of said spring portion is latchably engaged with the blocks.

* * * * *